US006812916B2

(12) United States Patent
Hwang

(10) Patent No.: US 6,812,916 B2
(45) Date of Patent: Nov. 2, 2004

(54) DRIVING CIRCUIT FOR LCD BACKLIGHT

(75) Inventor: Beom Young Hwang, Kyunggi-do (KR)

(73) Assignee: LG Electronics Inc., Seoul (KR)

( * ) Notice: Subject to any disclaimer, the term of this patent is extended or adjusted under 35 U.S.C. 154(b) by 520 days.

(21) Appl. No.: 09/879,895

(22) Filed: Jun. 14, 2001

(65) Prior Publication Data

US 2002/0003525 A1 Jan. 10, 2002

(30) Foreign Application Priority Data

Jul. 6, 2000 (KR) ..... 2000-38615

(51) Int. Cl.[7] ..... G09G 3/36; G09G 5/00; H05B 41/16

(52) U.S. Cl. ..... 345/102; 345/212; 315/276

(58) Field of Search ..... 345/102, 212; 315/276

(56) References Cited

U.S. PATENT DOCUMENTS 5,936,359 A * 8/1999 Gibson ..... 315/276
6,097,158 A * 8/2000 Manor et al. ..... 315/127
6,346,800 B1 * 2/2002 Mano et al. ..... 323/282
6,466,196 B1 * 10/2002 Isogawa et al. ..... 345/102
6,498,437 B1 * 12/2002 Chang et al. ..... 315/141

* cited by examiner

*Primary Examiner*—Richard Hjerpe
*Assistant Examiner*—M. Fathaiyan
(74) *Attorney, Agent, or Firm*—Birch, Stewart, Kolasch & Birch, LLP

(57) ABSTRACT

The present invention relates to a driving circuit for an LCD backlight lamp which can feed back some of a current flowing in a lamp with electrical insulation. This driving circuit for an LCD backlight lamp is able to eliminate stray capacitances which might reside in the secondary side of a boosting transformer, and minimize a leakage current due to the stray capacitances. Therefore, the power feeding time of a battery is extended in a portable device such as laptop computer.

4 Claims, 4 Drawing Sheets

Conventional Art

Conventional Art

DRIVING CIRCUIT FOR LCD BACKLIGHT

BACKGROUND OF THE INVENTION

1. Field of the Invention

The present invention relates to a driving circuit for an LCD backlight lamp, more particularly to a driving circuit minimizing a leakage current due to stray capacitances residing in its lamp driving side.

2. Description of the Related Art

Generally, a battery is used as a power source for laptop computers that use an LCD as a main display device. An LCD uses a backlight lamp to supply an amount of light required for illuminating pixels to display data or information since it cannot generate light by itself. In addition, because a high voltage of about 1000–1500V is required to drive a backlight lamp, a low-voltage DC power supplied from a battery should be converted to high-voltage AC power. For satisfying this requirement, a driving circuit for a backlight lamp such as FIG. 1 is used.

FIG. 1 depicts a conventional driving circuit for an LCD backlight lamp. The driving circuit of FIG. 1 comprises a DC/DC converter 120 generating a DC voltage of higher level by switching the DC power supplied from a battery 110 according to a PWM (Pulse Width Modulation) control signal from a PWM controller 121; an inverter 130 consisting of an AC oscillator 131 which swings sinusoidally with an amplitude of the high DC voltage from the DC/DC converter 120 and a transformer T1 which boosts the AC output of the oscillator 131 to its secondary side; a Ballast capacitor C2 applying the boosted AC power from the transformer T1 to a backlight lamp 150 at initial state and absorbing some power to protect the driven lamp at stable state; a current sensor 160 sensing the current flowing in the lamp 150 after rectifying; and a luminosity controller 170 comparing the magnitude sensed by the current sensor 160 with an adjustable reference level which is set externally, and outputting a control signal to vary a duty ratio of the PWM control signal of the PWM controller 121 according to the comparison result.

The operation of the LCD backlight driving circuit configured as FIG. 1 will be explained in detail.

The DC/DC converter 120 always provides the inverter 130 with a high DC voltage by switching the DC power supplied from the battery 110 according to PWM control signal, and the inverter 130 converts the high DC voltage from the DC/DC converter 120 to high voltage AC power through the internal AC oscillator 131 and the transformer T1. While dissipating the supplied AC power, the lamp 150 emits light. At the moment when the lamp 150 starts to be driven, the Ballast capacitor C2 enables the high starting voltage (1000–1500V) to be instantly applied to the lamp 150, and then it absorbs some of the AC power outputted from the inverter 130 to protect the driven lamp 150, which guarantees stable operation of the lamp 150 after the lamp 150 is driven.

The current sensor 160 rectifies positive half waves through a diode D1 because the current driving the lamp 150 is an alternating current, and it flattens the rectified waves through a resister R7 and a capacitor C3. Then, the luminosity controller 170 compares the flattened magnitude outputted from the current sensor 160 with a reference which is adjustable manually, and outputs a difference signal, which is the result of the comparison, to change the duty ratio of the PWM-control signal of the PWM controller 121. Due to this feedback control based on a set reference and the fed back lamp current, it is possible to supply constant electric energy for the lamp 150, so that the desired brightness is maintained constantly.

In the conventional lamp driving circuit that operates as described above, the current flowing in the lamp 150 is fed back through the current sensor 160 and the luminosity controller 170 for PWM-control of the DC/DC converter 120 so that constant electric energy might be supplied to the lamp 150 to maintain a desired brightness. However, because the secondary side of the transformer T1 is connected to the primary side via a ground in order to establish a feedback loop as described above, stray capacitances are formed unwantedly along the high power path of the secondary side and around its windings and the lamp 150. Because of a leakage current induced by such stray capacitances, the efficiency of power consumption is lowered.

That is, in the conventional backlight driving circuit, stray capacitances Cx (marked as dotted lines) are formed, as depicted in FIG. 2, between the lamp 150 and a lamp protection reflector grounded, and along the high power path of the secondary side of the transformer T1. Therefore, a leakage current flows to a ground through the stray capacitances Cx. Because the leakage current due to the stray capacitances Cx is about 10% (in the condition of $i=2\Pi fcv$, f=50 kHz, V=700V, and C=about 20 pf) of the lamp driving current, all the energy provided from the secondary side of the transformer T1 is not used to drive the lamp 150, thus the efficiency of power consumption is not good.

SUMMARY OF THE INVENTION

It is an object of the present invention to provide an LCD backlight driving circuit being able to minimize a leakage current through stray capacitances by conducting feedback of some load current with electrical insulation between the primary and secondary side of a transformer.

A driving circuit for an LCD backlight according to the present invention comprises a DC/DC converter changing the level of an input DC power; an inverter converting the level-changed DC power into AC, boosting the converted AC power to higher voltage AC power, which is to be applied to a lamp, according to the ratio of a primary and a secondary winding; a feedback means sensing the AC current flowing in the lamp, feeding back the sensed current with electrical insulation between the primary and the secondary side, and flattening the fed back current; and a level controller comparing the flattened current with a reference signal, and providing the difference signal between the two compared signals to the DC/DC converter which adjusts a target level according to the difference signal. More particularly, the feedback means comprises a photo coupler rectifying the AC current flowing in the lamp and feeding back to the primary side, or an auxiliary transformer inducing the AC current of the lamp to its secondary winding with electrical insulation.

The driving circuit for an LCD backlight lamp according to the present invention, can eliminate stray capacitances which might reside in the lamp driving side, and minimize a leakage current through stray capacitances.

BRIEF DESCRIPTION OF THE DRAWINGS

The accompanying drawings, which are included to provide a further understanding of the invention, illustrate the preferred embodiments of the invention, and together with the description, serve to explain the principles of the present invention.

In the drawings.

DETAILED DESCRIPTION OF THE PREFFERRED EMBODIMENT

The accompanying drawings illustrate the preferred embodiments of the present invention, and together with the description, serve to explain the principles of the present invention.

Figure 1:
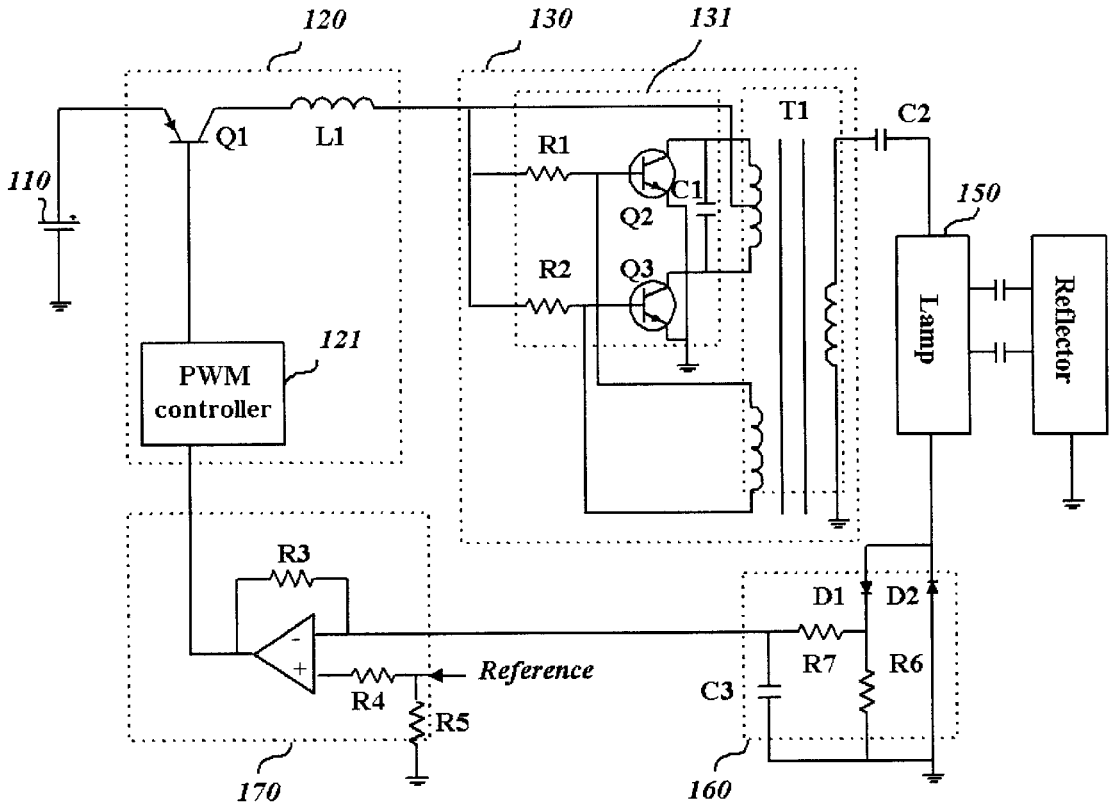
FIG. 1 depicts a conventional driving circuit for an LCD backlight lamp.
Figure 2:
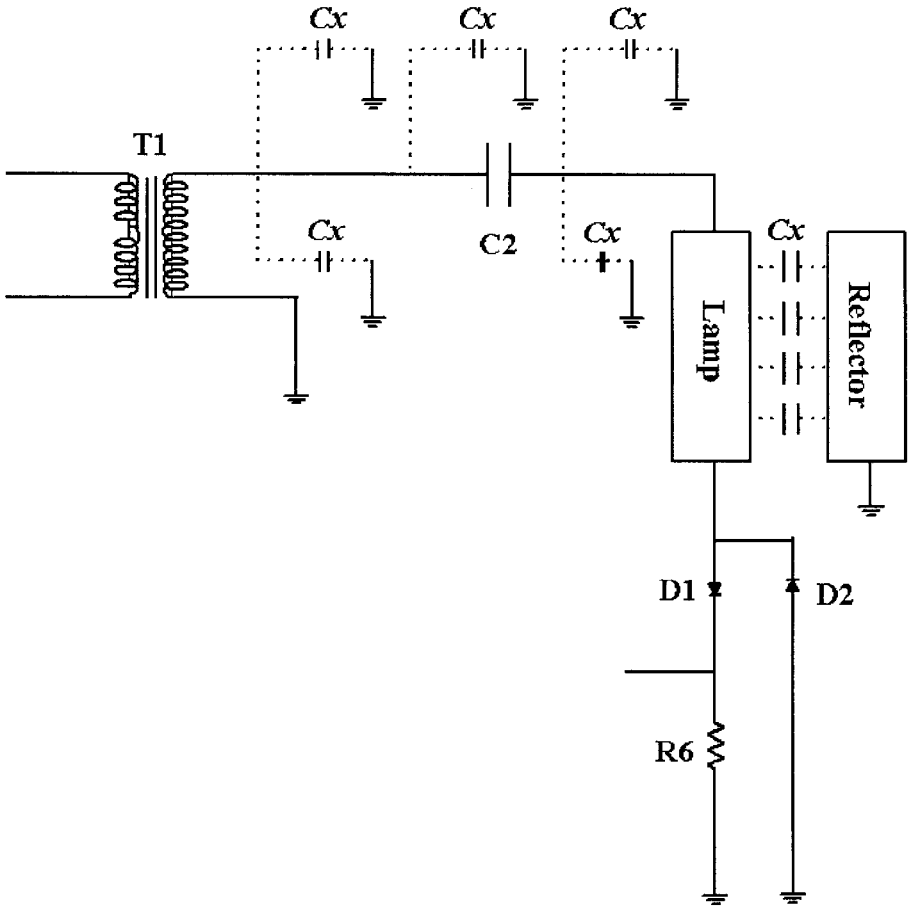
FIG. 2 illustrates stray capacitances formed in a lamp driving side of the circuit of FIG. 1.
Figure 3:
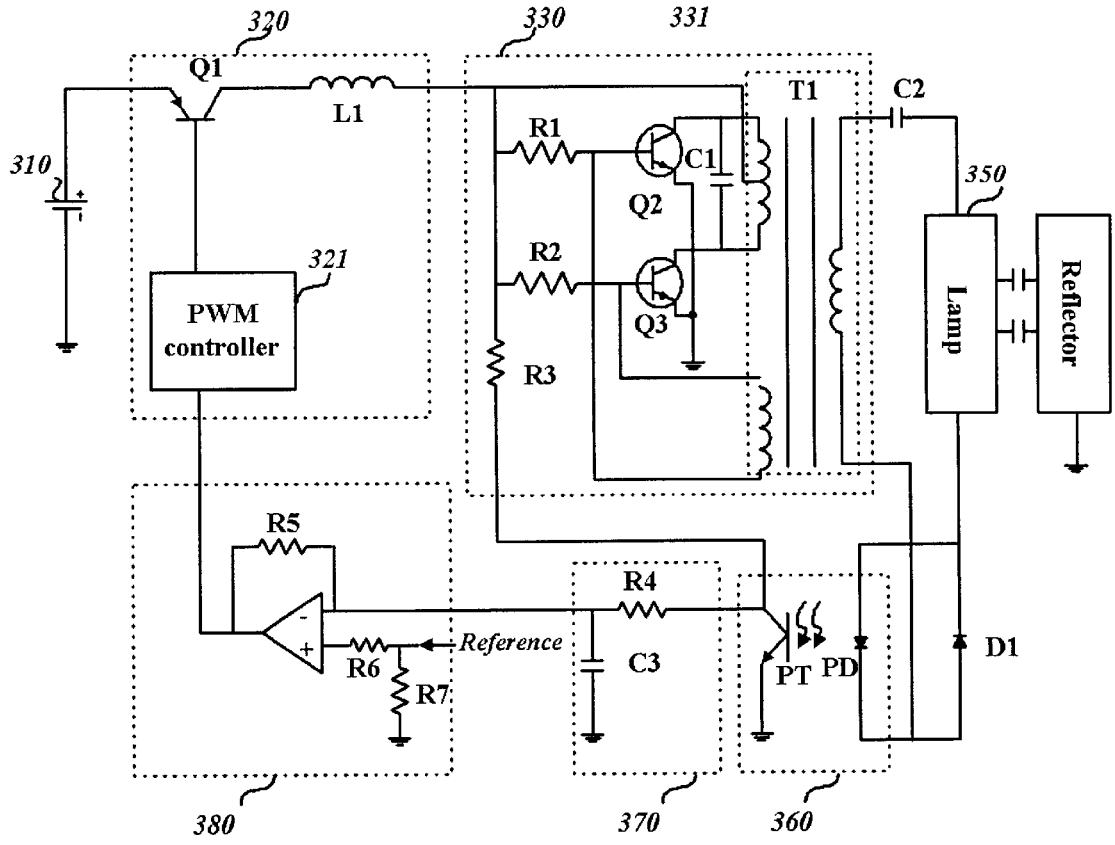
FIG. 3 is a driving circuit for an LCD backlight lamp according to the present invention including a photo coupler as an insulating means.

FIG. 3 depicts a circuit diagram of a backlight lamp driving circuit according to the present invention. The driving circuit of FIG. 3 comprises a DC/DC converter 320 generating a DC voltage of higher level by switching the DC power supplied from a battery 310 according to a PWM control signal of an internal PWM controller 321; an inverter 330 consisting of an AC oscillator 331 which swings sinusoidally with an amplitude of the high DC voltage from the DC/DC converter 320 and a transformer T1 boosting the AC output of the oscillator 331 to its secondary side; a Ballast capacitor C2 applying the boosted AC power from the transformer T1 to a backlight lamp 350 at initial driving state, and absorbing some power to protect the driven lamp 350 at stable state; a photo coupler 360 feeding back the AC current flowing in the lamp 350 with electrical insulation, to the primary side from the secondary of the transformer T1; a DC filter 370 flattening the half-wave current outputted from the photo coupler 360; and a luminosity controller 380 comparing the magnitude flattened by the DC filter 370 with a desired set-point which is adjustable manually, and outputting a regulating signal to change the duty ratio of the PWM control signal of the DC/DC converter 320 according to the comparison result. The flattened magnitude and the desired set-point are compared to each other at the inverting (−) and non-inverting terminal (+) of a comparator, and the difference between the two signals is applied to the PWM controller 321 as the regulating signal.

The DC/DC converter 320 consists of a power transistor Q1 whose emitter is connected to the battery 310; the PWM controller 321 whose output is applied to the base of the transistor Q1; and an inductor L1 connected to the collector of the transistor Q1 to boost switched voltage from the transistor Q1.

The AC oscillator 331 of the inverter 330 consists of resistors R1 and R2 connected to the inductor L1; a resistor R3 connected between the inductor L1 and the collector of a photo transistor of the photo coupler 360; two transistor Q2 and Q3 whose bases are connected to the resistor R2 and R3 respectively and whose emitters are commonly grounded; a capacitor C1 connected between the collectors of the transistors Q2 and Q3. In addition, the transformer T1 of the inverter 330 is connected with the neighboring circuits such that its first winding of the primary side is connected between each collector of the transistors Q2 and Q3, its second winding of the primary side is connected between each base of the transistors Q2 and Q3, the secondary winding is connected between the Ballast capacitor C2 and the cathode of a photo diode of the photo coupler 360.

The input terminal of the lamp 350 is connected to the Ballast capacitor C2 and its output terminal is connected to the anode of the photo diode of the photo coupler 360. Another diode D1 is connected in parallel with the photo diode of the photo coupler 360 such that their connected directions are opposite each other.

The photo transistor of the photo coupler 360 is connected with a resistor R4 at its collector and its emitter is grounded.

The DC filter 370 comprises the resistor R4 whose other end is connected to the inverting terminal of the comparator of the luminosity controller 380; and a capacitor C3 connected between the inverting terminal and a ground.

The luminosity controller 380 comprises the comparator whose non inverting terminal is connected to a ground through serial connected two resistors R6 and R7. The output terminal of the comparator is connected to the PWM controller 321, and it is also connected with the inverting terminal through a resistor R5. A reference signal for a desired set-point is applied to the connection point of the two resistors R6 and R7.

A detailed explanation on the operation of the present backlight lamp driving circuit will be provided with reference to FIG. 3.

If a DC power is supplied from the battery 310, it is inputted to the first transistor Q1 of the DC/DC converter 320 and is switched according to the PWM control signal from the PWM controller 321 and is then fed to the inductor L1. The inductor L1 boosts the switched DC voltage and provides it to the inverter 330. The chopped and boosted DC voltage fed to the inverter 330 is converted to an AC power by the AC oscillator 331 whose transistors Q2 and Q3 turn on/off alternatively. The AC voltage inverted by the AC oscillator 331 is transformed to high voltage 1000–1500V in accordance with the ratio of the first winding of the primary side to secondary winding of the transformer T1. When the high AC power is supplied from the inverter 330 to the lamp 350, the lamp 350 emits enough light.

At the moment when the lamp 350 starts to be driven, the Ballast capacitor C2 applies the high starting voltage (1000–1500V) to the lamp 350 instantly, and it absorbs some of the AC power outputted from the inverter 330 to protect the driven lamp 350 after initial state diminishes, which guarantees a stable operation of the lamp 350 after the lamp 350 is driven.

While the lamp 350 is being driven, the AC current flows in the lamp 350 and the diode D1 during the negative half wave, and the photo diode of the photo coupler 360 during the positive half wave. While a current flows in the photo diode, the photo transistor turns on, so that the voltage at the collector of the photo transistor is proportional to the magnitude of the current flowing in the lamp 350. This signal transmission is conducted by the intensity of radiation with insulation between the two photo elements.

The rectified half-wave current at the collector of the photo transistor becomes almost flat through the DC filter 370. The comparator of the luminosity controller 380 receives the flattened DC level from the DC filter 370 at its inverting terminal, and compares the received level with the reference level set based on a desired luminosity. According to the comparison, the difference signal between the two levels is sent to the PWM controller 321 which uses the difference signal for adjusting a duty ratio of its own PWM signal to be applied to the base of the transistor Q1. Due to this feedback control based on a set reference and the fed back lamp current, it is possible to supply constant electric energy for the lamp 150, so that the desired backlight brightness is maintained constantly.

Figure 4:
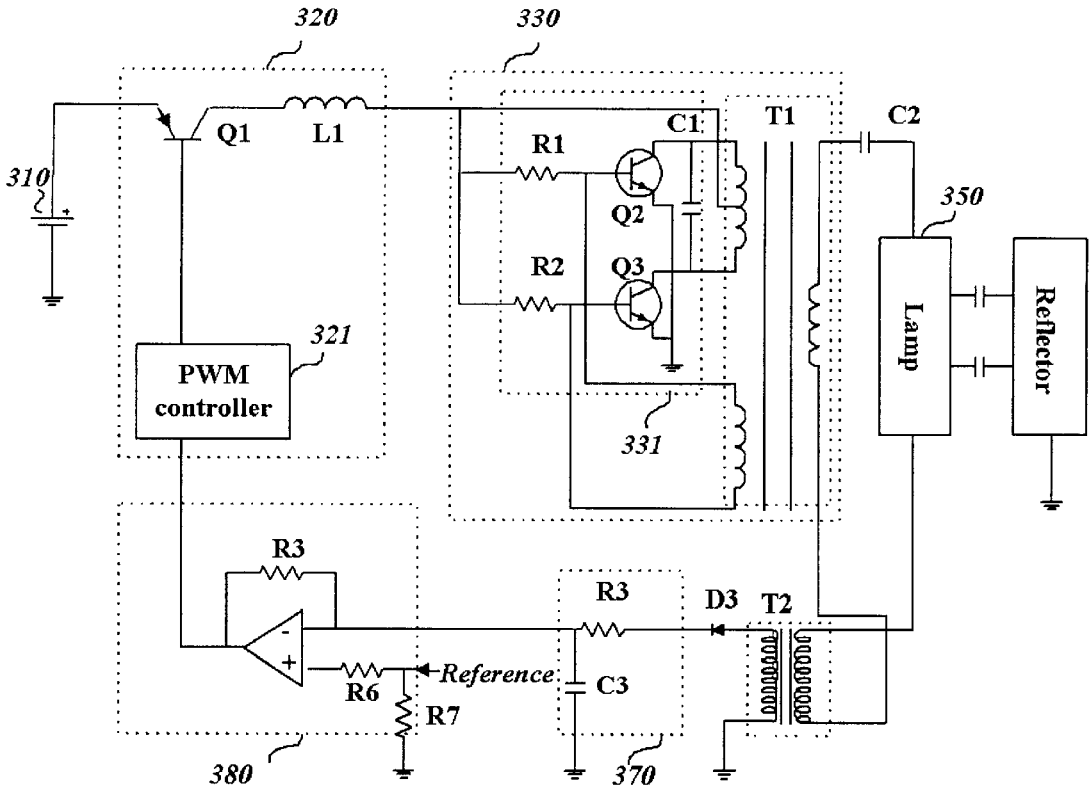
FIG. 4 is another driving circuit for an LCD backlight lamp according to the present invention including an auxiliary transformer as an insulating means.

FIG. 4 depicts another circuit diagram of a backlight lamp driving circuit according to the present invention. The same elements as in FIG. 3 will be assigned to identical numeric designations, and the explanation for them is omitted. However, different elements and their operations will be described.

In the circuit of FIG. 4, instead of the photo coupler 360, an auxiliary transformer T2 feeds back the AC current flowing through the lamp 350 with insulation between the primary and the secondary side of the transformer T1, and a diode D3 connected to the secondary side of the auxiliary transformer T2 rectifies the AC energy delivered through the transformer T2 and applies the rectified half-wave current to the DC filter 370. The resistor R3 and the diode D1 of FIG. 3 are removed in the circuit of FIG. 4.

The newly configured parts of the circuit of FIG. 4 operate as follows. The auxiliary transformer T2 is electrically insulated between its primary and secondary side and induces a current proportional to the load current flowing through the primary winding at the secondary to feed back some of the current driving the lamp 350. The induced current is AC and it is rectified into a positive half-wave current through the diode D3. The half-wave current is flattened by the DC filter 370 and is then fed to the inverting terminal of the comparator in the luminosity controller 380. Subsequent operations are the same as in the above explanation related to the driving circuit of FIG. 3.

The backlight lamp driving circuit according to the present invention can insulate electrically between the primary and the secondary side of the boosting transformer in feeding back some of a load current driving the lamp, to prevent stray capacitance from being formed between a lamp protection reflector and between the secondary side and the ground. Due to the elimination of stray capacitance, there is little power loss caused by the leakage current, which extends a power feeding time of a battery which a portable device such as a laptop computer should be equipped with.

What is claimed is:

1. A driving circuit for an LCD backlight, comprising:

a DC/DC converter changing the level of an input DC power;

an inverter converting the level-changed DC power into AC, boosting the converted AC power to higher voltage AC power, which is to be applied to a lamp, according to the ratio of a primary eside winding and a secondary side winding of a transformer;

a feedback means sensing the AC current flowing in the lamp, feeding back the sensed current with electrical insulation between the primary side and the secondary side of the transformer, and flattening the fed back current wherein said feedback means comprise a photo coupler rectifying the AC current flowing in the lamp and feeding back the rectified current with electrical insulation; a rectifying element connected between the secondary winding and the lamp; and a DC filter flattening the output signal of the coupler; and a level controller comparing the flattened current with a reference signal, and providing the difference signal between the compared signals to the DC/DC converter which adjusts a target level to change according to the difference signal.

2. The driving circuit set forth in claim 1, wherein said photo coupler is connected such that an internal photo diode is connected with opposite direction of said rectifying element between one end of the secondary winding and the lamp, and an internal photo transistor is connected to the outlet of said DC/DC converter through a resistor and a ground at its collector and emitter, respectively, and wherein said DC filter comprises a resistor connected between the collector of the photo transistor and a non-inverting terminal of a comparator of said level controller; and a capacitor connected between the ground and the non-inverting terminal.

3. A driving circuit for an LCD backlight, comprising:

a DC/DC converter changing the level of an input DC power;

an invertter converting the level-changed DC power into AC, boosting the converted AC power to higher voltage AC power, which is to be applied to a lamp, according to the ratio of a primary side winding and a second side winding of a transformer;

a feedback means comprising:

an auxiliary transformer inducing the AC current flowing in the lamp to its primary side with electrical insulation;

a rectifying element rectifying the AC energy induced by the auxiliary transformer; and a DC filter flattening the output signal of the rectifying element; and a level controller comparing the flattened current with a reference signal, and providing the difference signal between the compared signals to the DC/DC converter which adjusts a target level to change according to the difference signal.

4. The driving circuit set forth in claim 3, wherein the primary winding of the auxiliary transformer is connected in a loop in which the lamp is inserted, the secondary winding is connected with the rectifying element and a ground at both ends, and the remaining end of the rectifying element is connected to the DC filter.

* * * * *